US011667430B2

(12) United States Patent
Collis et al.

(10) Patent No.: US 11,667,430 B2
(45) Date of Patent: Jun. 6, 2023

(54) SELF-SEALING CONTAINER

(71) Applicant: SAFESEAL-SYSTEMS, Palm Harbor, FL (US)

(72) Inventors: Ronald Collis, Palm Harbor, FL (US); James Ryan Bowen, Clearwater, FL (US)

(73) Assignee: SAFESEAL-SYSTEMS, Palm Harbor, FL (US)

( * ) Notice: Subject to any disclaimer, the term of this patent is extended or adjusted under 35 U.S.C. 154(b) by 0 days.

(21) Appl. No.: 17/679,376

(22) Filed: Feb. 24, 2022

(65) Prior Publication Data

US 2022/0250790 A1 Aug. 11, 2022

Related U.S. Application Data

(63) Continuation of application No. 17/338,741, filed on Jun. 4, 2021, now Pat. No. 11,286,081.

(Continued)

(51) Int. Cl.

*B65D 5/54* (2006.01)
*B65D 5/42* (2006.01)

(Continued)

(52) U.S. Cl.

CPC ..... *B65D 5/548* (2013.01); *B65B 5/024* (2013.01); *B65B 5/04* (2013.01); *B65D 5/18* (2013.01);

(Continued)

(58) Field of Classification Search

CPC ..... B65D 5/548; B65D 5/18; B65D 5/4233; B65D 5/4266; B65D 5/6685;

(Continued)

(56) References Cited

U.S. PATENT DOCUMENTS 3,206,103 A 9/1965 Bixler
3,306,521 A 2/1967 Giacovas (Continued)

FOREIGN PATENT DOCUMENTS

EP 2390196 3/2014
JP 2013513531 4/2013

(Continued)

OTHER PUBLICATIONS

Biodegradable self sealing black box self adhesive strip tear shipping packaging box brown quick seal postal box Publisher: Shenzhen Sinmenda Packaging Co., Ltd URL link: https://www.alibaba.com/product-detail/biodegradableelf-sealing-black-box-self_1600175081 056.html?spm=a2700; 1999-2021.

(Continued)

*Primary Examiner* — Christopher R Demeree
(74) *Attorney, Agent, or Firm* — FisherBroyles LLP; Anthony Dovale

(57) ABSTRACT

A self-sealing container is formed from a blank comprising panels and end flaps connected along fold lines with the panels and the end flaps being foldable along the fold lines to form the container. The container includes a securing feature that seals the container in a closed position, with the securing feature providing a visual indication of opening if the container is opened from the closed position. After the container is opened, the securing feature provides a closure feature that allows the container to be closed.

10 Claims, 14 Drawing Sheets

Related U.S. Application Data

(60) Provisional application No. 63/034,941, filed on Jun. 4, 2020.

(51) Int. Cl.

| | |
|---|---|
| ***B65D 5/18*** | (2006.01) |
| ***B65D 5/66*** | (2006.01) |
| ***B65B 5/02*** | (2006.01) |
| ***B65B 5/04*** | (2006.01) |

(52) U.S. Cl.
CPC ..... *B65D 5/4233* (2013.01); *B65D 5/4266* (2013.01); *B65D 5/6685* (2013.01)

(58) Field of Classification Search
CPC ..... B65D 2585/366; B65D 5/2057; B65D 33/34; B65D 2401/00; B31B 50/25; B31B 50/734; B31B 2120/102
USPC ..... 229/906, 151, 152, 153, 154, 227, 102; 206/807; 220/359.2
See application file for complete search history.

(56) References Cited

U.S. PATENT DOCUMENTS

| | | | | |
|---|---|---|---|---|
| 3,366,310 | A | 1/1968 | Simpson et al. | |
| 3,551,965 | A | 1/1971 | Gordon | |
| 4,046,313 | A | 9/1977 | Perry | |
| 4,296,529 | A | 10/1981 | Brown | |
| 4,656,697 | A | 4/1987 | Naslund | |
| 4,773,542 | A * | 9/1988 | Schillinger | B65D 5/4266 229/905 |
| 4,907,698 | A * | 3/1990 | Konrad | B65D 5/5435 53/381.1 |
| 5,008,980 | A | 4/1991 | Zimmermann | |
| 5,050,272 | A | 9/1991 | Robinson | |
| 5,366,141 | A | 11/1994 | Stone | |
| 5,375,300 | A | 12/1994 | Chen | |
| 5,379,489 | A | 1/1995 | Delk | |
| 5,428,871 | A | 7/1995 | Iosif | |
| 5,713,108 | A | 2/1998 | Solomon | |
| 5,971,262 | A | 10/1999 | Moore | |
| 5,975,415 | A | 11/1999 | Zehnal | |
| 6,685,085 | B2 | 2/2004 | Hanna | |
| 6,904,646 | B2 | 6/2005 | Reynolds | |
| 7,062,822 | B2 | 6/2006 | Folkmar | |
| 10,569,927 | B2 * | 2/2020 | Herkenrath | B65D 5/546 |
| 10,807,772 | B2 | 10/2020 | Ruddell | |
| 2005/0199695 | A1 | 9/2005 | Debusk | |
| 2014/0305944 | A1 * | 10/2014 | Lahlouh | B65D 5/546 229/125.33 |
| 2016/0304234 | A1 | 10/2016 | Herkenrath | |
| 2019/0344927 | A1 | 11/2019 | Ozgercel | |
| 2021/0323717 | A1 * | 10/2021 | DeJesus | B65D 5/6667 |

FOREIGN PATENT DOCUMENTS

| | | |
|---|---|---|
| WO | 1988/02727 | 4/1988 |
| WO | 2018/028233 | 2/2018 |

OTHER PUBLICATIONS

Custom logo corrugated peel off self seal postal zipper mailing mailer boxes adhesive tear strips box Publisher: Impression Packaging Products (Guangzhou) Co., Ltd. URL link: https://www.alibaba.com/product-detaii/Custom-logo-Corrugated-peel-off-self_16001172167 47.html?spm=a2700.7724857.0.0.1 ceb791 ajnh5QD; 1999-2021.

"Tear strip boxes" Publisher: Alibaba.com URL link: https://www.alibaba.com/showroom/tear-strip-boxes.html? Spm=a2700.7724857.0.0.7b4a791adkskRn; 1999-2021.

"Bag sealer clip" Jiaxing; URL link: https://www globalsources.com/Bag-clip/Bag-sealer-clip-1180463867p.Htm#1180463867:2021.

"Food Bag Sealer Clips" Publisher: straightbuy URL link: https://straightbuy.in/productlfood-bag-sealer-clips-18-pc-kitchen-clips/; 2020.

"Tamper-evident A5-size Envopak Reusable Security Bags" Publisher: Envopak; URL link: https://www.safetyshop.com/envopak-re-usable-security-bags-a5.htmi#SEC977%20RD; 2021.

"Pull Seal" Publisher: Alta Max; URL link: https://www.altamax.net/store/p/111-Pull.aspx; 2021.

"Security Seals : Plastic, Metal or Cable Seals"; Publisher: Jiji.ng; URL link: https://jiji.ng/lagos/safety-equipment/security-seals-plastic-metal-or-cable-seals-aMLXH5xYBseS1wswwYY4NBf7.html; 2021.

International Application No. PCT/US2021/035815, International Search Report and Written Opinion, ISA/US, dated Oct. 20, 2021, 11 pp.

* cited by examiner

SELF-SEALING CONTAINER

Delivery of prepared food and fresh grocery items has become increasingly popular. However, once the food or item has left the restaurant, grocery store, or other seller, opportunities abound for intentional or accidental tampering of the food or other item. Tampering of the food or other item, or simply exposing the contents, not only impacts the safety/quality/quantity available, but these instances increase operational and customer service-related costs for both the delivery service and the supplier. Further still, the coronavirus pandemic has heightened awareness of the chain of custody of items prepared (e.g., food from restaurants, hotels, entertainment venues, cruise lines, etc.), gathered (e.g., delivery services that shop at grocery stores on other's behalf), and packaged (e.g., prescription drug deliveries).

BRIEF DESCRIPTION OF THE DRAWINGS

The accompanying drawings, which are incorporated herein and constitute part of this specification, illustrate exemplary embodiments of the disclosure, and, together with the detailed description below, serve to explain features of the disclosure. In the drawings.

DETAILED DESCRIPTION

Figure 1A:
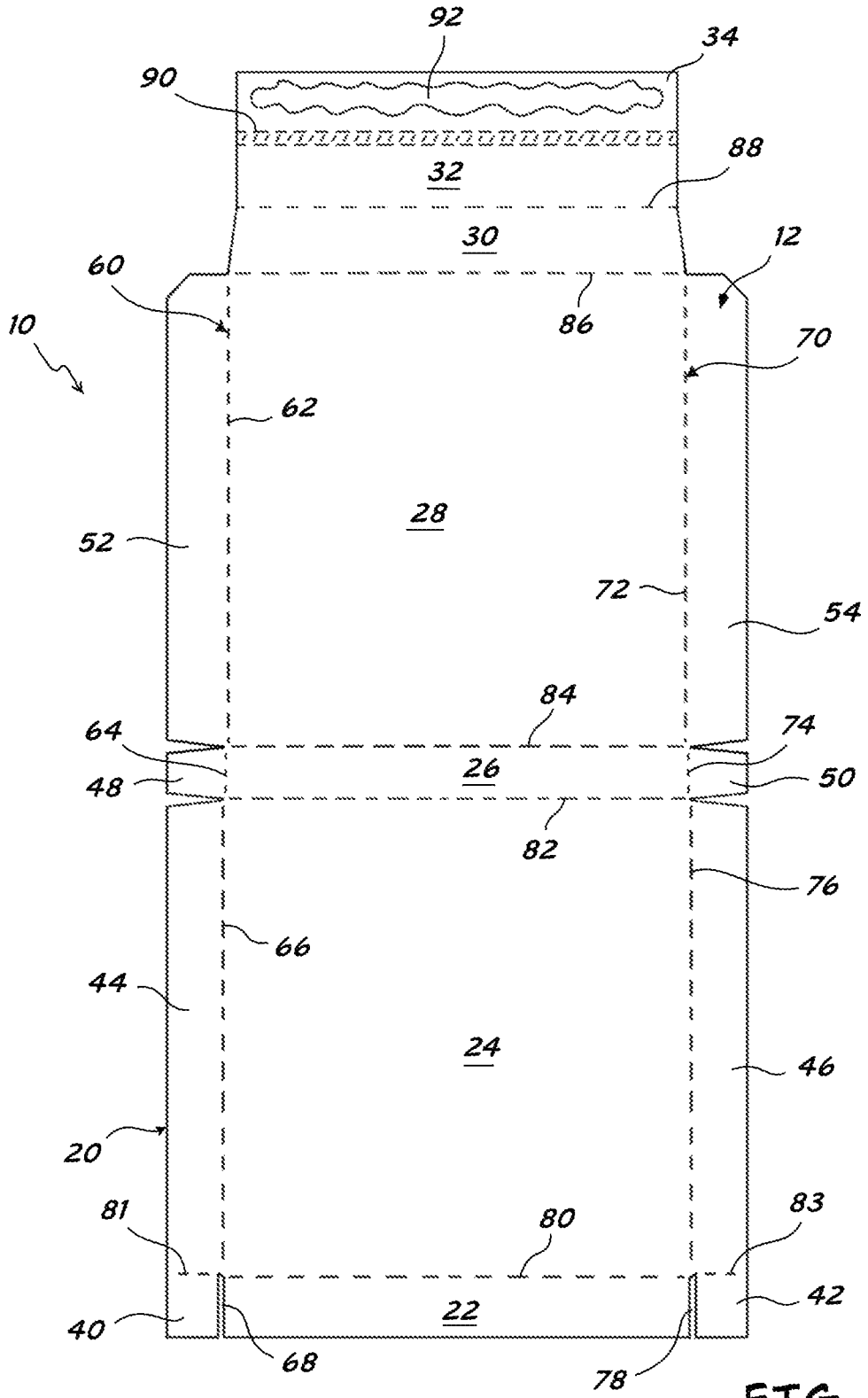
FIG. 1A is an unassembled plan view of an exemplary container according to a first embodiment.

In the drawings, like numerals indicate like elements throughout. Certain terminology is used herein for convenience only and is not to be taken as a limitation on the present disclosure. The terminology includes the words specifically mentioned, derivatives thereof and words of similar import. The embodiments illustrated below are not intended to be exhaustive or to limit the disclosure to the precise form disclosed. These embodiments are chosen and described to best explain the principles, application and practical use, and to enable others skilled in the art to best utilize the disclosure.

In one aspect, the exemplary embodiments shown herein provide a secure delivery mechanism to eliminate tampering and accidental exposure to contaminants, such as for food and items and other deliverables. Among other benefits, the exemplary embodiments detailed herewithin eliminate tampering from the time food or other items are ready for delivery until the food or other items are delivered to the intended recipient. While food, prescription drugs, money, groceries, etc. are discussed herein, benefits of the exemplary embodiments can be realized to secure from touching, contaminating, or otherwise impacting in any manner anything sensitive or personal before an intended recipient accesses the delivery mechanism. Some conventional scenarios that could be addressed and/or eliminated by utilizing the exemplary embodiments can include:

Example 1) A food delivery driver sampling food in transit.

Example 2) A food delivery driver opening a bag or container to examine contents therein, and touching, adjusting, or other otherwise contaminating the food in transit.

Example 3) A food delivery driver opening a bag or container to examine contents and, even without physically touching the contents, contaminate the food by allowing dust, bacteria, or any particulate into the open bag or container.

Example 4) An employee transporting money, e.g., from a store to a bank to make a deposit, could eliminate suspicion of the employee if the count is off on either end.

Example 5) A package may accidentally be dropped, shaken, shifted suddenly, or fall off the car seat in transit and therefore open the box and expose the contents.

Additionally, the exemplary embodiments will retain confidence in products delivered to ensure security and will save resources and costs by creating accountability for the supplier/sender and the transporting party and personnel. In at least one aspect, the exemplary embodiments can be secured for delivery and only opened by the intended recipient. For example, if a vendor applies the secure delivery mechanism upon completing an order before the order is picked up for delivery, at least the following benefits can be recognized:

The sender (e.g., a vendor) cannot claim that the transporter is responsible for any missing items from the order.

The intended recipient cannot claim the transporter tampered with the order.

In at least one aspect, the exemplary embodiments provide a secure system for the transporting party essentially to guarantee that the food/item left the restaurant/store (e.g., vendor) in the condition received by the intended recipient. Additionally, this secure system removes the delivery driver, or the company employing the delivery driver, from blame if the food/item order as delivered is incorrect.

Figure 1B:
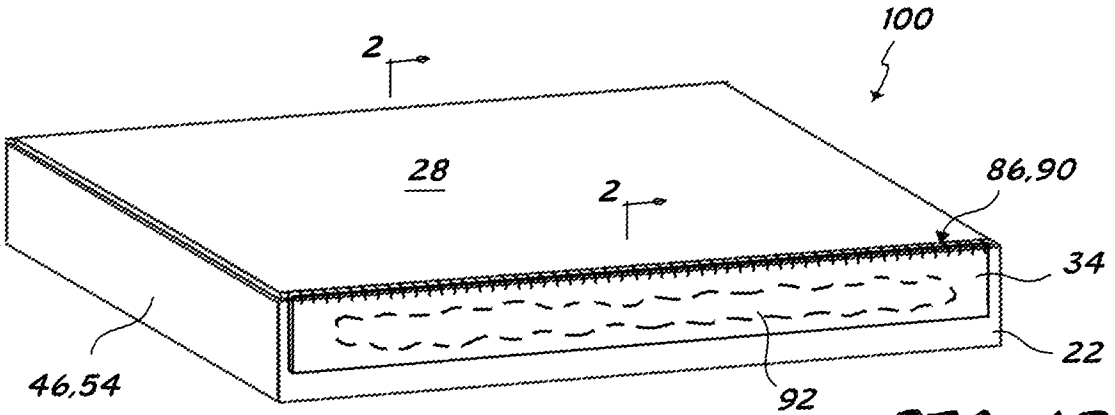
FIG. 1B is a perspective view of the exemplary container of FIG. 1A.
Figure 2:
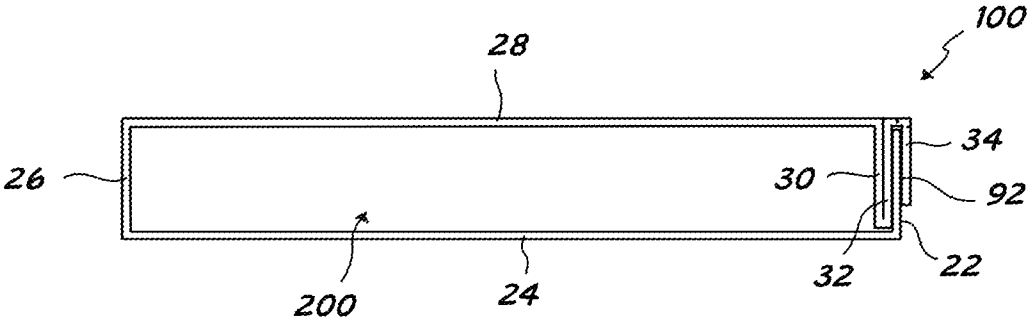
FIG. 2 is a cross sectional view along lines 2-2 of FIG. 1B.

In one aspect, the present device includes a self-sealing container formed of two mating sections capable of being disposed adjacent, or mated one into another, to create a closed shell or container, such as shown in FIGS. 1A, 1B, and 2. FIG. 1A is an unassembled plan view of an exemplary container according to a first embodiment. FIG. 1B is a perspective view of the exemplary container of FIG. 1A. FIG. 2 is a cross sectional view along lines 2-2 of FIG. 1B.

FIG. 1A shows a blank 10 that includes panels 22, 24, 26, 28, 30, 32, 34. These panels are connected along fold lines, which include both latitude fold lines, such as are indicated at 80, 81, 82, 83, 84, 86, 88, and longitudinal fold lines, such as are indicated at 60 and 70, with individual segments of fold lines 60 at 62, 64, 66, and individual segments of fold line 70 at 72, 74, 76. Panels 22 and 24 are connected along fold line 80, panels 24 and 26 are connected along fold line 82, panels 26 and 28 are connected along fold line 84, panels 28 and 30 are connected along fold line 86, panels 30 and 32 are connected along fold line 88, and panels 32 and 34 are connected along tear strip line 90. Panels 30, 32, and 34 form an end of the blank 10 and can be articulated when the blank 10 is folded to form a container 100 (FIG. 1B) to provide a secure, openable, and reclosable feature. As shown in FIG. 1A, the tear strip 90 can include multiple fold lines and or other additional features to allow the panels 30, 32, 34 to be articulated to form the closing feature as described further herewithin.

The blank 10 also includes end flaps connected to several of the panels. As shown in FIG. 1A, end flap 44 is connected along fold line 66 to panel 24 along a first edge and end flap 46 is connected along fold line 76 to panel 24 along a second edge. An end flap 40 is connected to end flap 44 along fold line 81 and an end flap 42 is connected along fold line 83 to end flap 46. Additionally, a gap, nick, or space 68 is shown between end flap 40 and panel 22 and a gap, nick, or space 78 is shown between end flap 42 and panel 22.

FIG. 1A shows the inside 12 of blank 10. Where appropriate to form the blank 10 into container 100, an adhesive 92 can be disposed onto blank 10 for securement of the blank 10 into a container configuration (FIG. 1B). As shown in FIG. 1A, the adhesive 92 in this exemplary embodiment is glue that has been applied to panel 34.

FIG. 1B shows the blank 10 being formed in a parallelepipedal configuration with the panels being folded from the orientation shown in FIG. 1A to form a closed container 100. As the blank 10 is folded, in the exemplary embodiment shown, panel 28 becomes a top of the container 100 and is spaced essentially parallel and disposed directly above panel 24. Panel 26 becomes a rear wall and panels 22 and the combination of panels 30, 32, 34 form a front wall that is spaced essentially parallel and disposed opposite panel 26. End flaps 40, 42, 44, 46, 48, 50, 52, 54 together form opposing side walls of container 100. Specifically, end flaps 44, 52 form a first side wall with end flaps 48 and 40 being folded into an interior of the container 100. Optionally, glue or other adhesive can be applied at any position there along the panels and end flaps, for example, an adhesive could be applied to end flaps 40 or 48 to secure a lower half of the container 100 together. The second side wall of the container 100 is formed by end flaps 46 and 54, with end flaps 42 and 50 being folded into an interior of the container 100. Optionally, glue or other adhesive can be applied at any position there along, for example, an adhesive could be applied onto end flaps 42 and 50 to secure the lower half of the container 100 together. While the container 100 is shown in a nesting configuration in FIGS. 1B and 2, the container 100 could be formed in a clam-shelf configuration, similar to the container shown in FIGS. 6-8.

FIG. 2 is a cross-section cut along lines 2-2 of FIG. 1B to show an interior portion 200 of the container 100. As can be seen in FIG. 2, panels 30 and 32 have been folded to be adjacent one another. Specifically, panel 30 is folded along fold line 86 to be disposed essentially parallel and opposite panel 26 in an interior 200 of container 100. Panel 32 is folded along fold line 88 to be disposed adjacent and substantially parallel to panel 30. Panel 34 is folded or otherwise articulated along at least a portion of fold line 90. As can be seen in FIG. 2, the thickness or width of fold line 90 between panels 32 and 34 allow for articulation of panel 34 over and there along panel 32 on an exterior portion 202 of the carton. The adhesive 92, as applied to an interior side of panel 34, allows panel 34 to be secured to an exterior portion of panel 22 with the adhesive acting as a seal or other securement means. In at least one embodiment, the adhesive 92 is strong enough and/or fast setting enough to quickly and immediately adhere the interior of panel 34 to the exterior panel 22. In this manner, once the adhesive is applied, separation or other detachment of the panel 34 from panel 22 in any manner will result in at least partial tearing of panel 34, panel 22, or both panel 22 and 34. Alternatively, separation and other detachment of panel 34 from panel 22 will provide a visual indication that the carton 100, which once was sealed, had been subsequently opened.

In one exemplary method of opening, order to use the seal shown in FIGS. 1A, 1B, and 2, at least a portion of panel 34 is removed or the fold line 90 is otherwise separated there along to expose the interior 200 of the container 100 by lifting panel 28 upwardly along fold line 84. In at least one exemplary embodiment, the adhesive 92 can be covered by a tab or other cover (not shown). The tab can be exposed, such as by peeling off, to reveal an adhesive portion. The panel 34 is then folded closed with the adhesive portion 92 securing panel 34 to panel 22. When the container 100 is to be opened, tab 94 defines a tear-away portion which allows the mating sections to be hinged or otherwise opened.

Figure 3A:
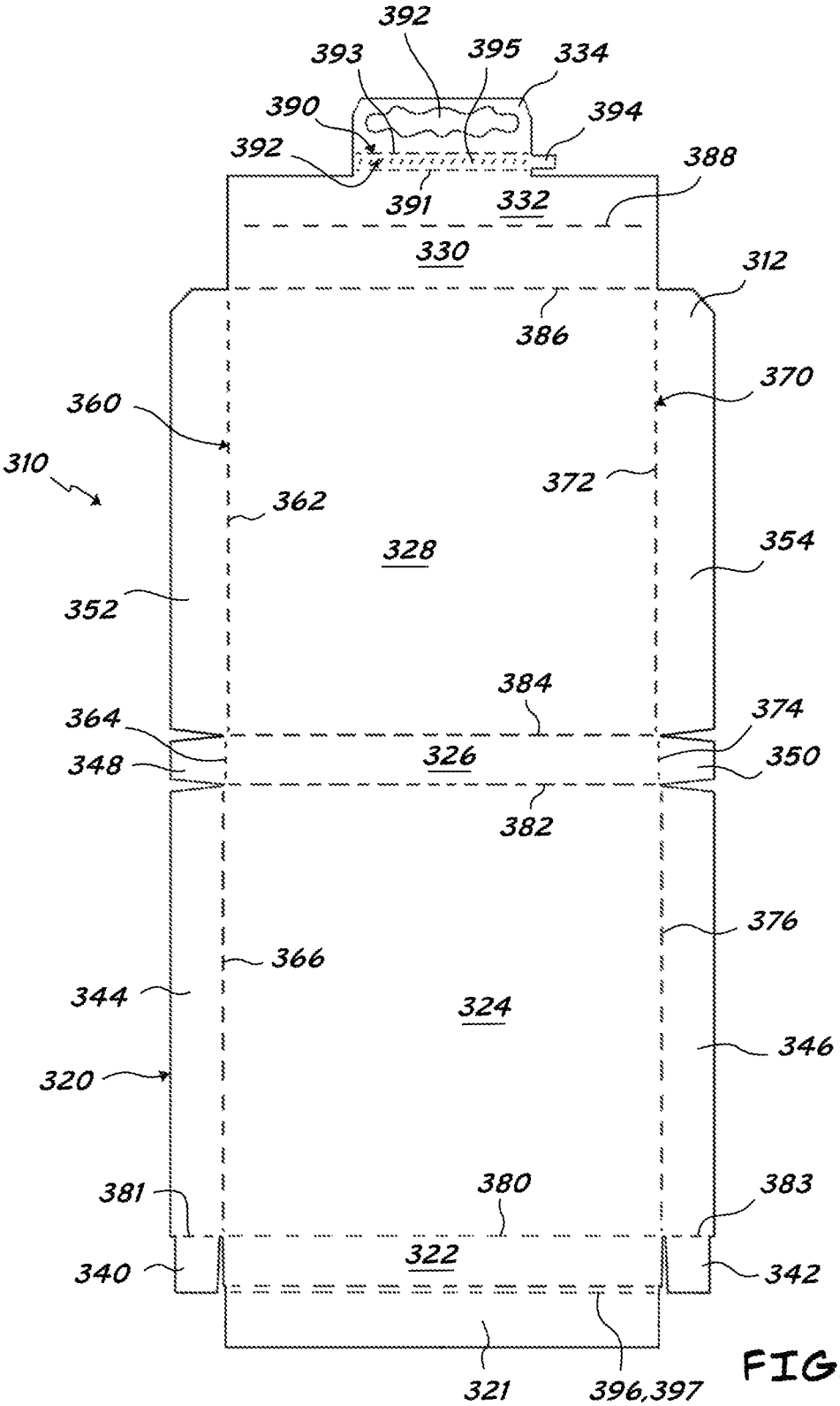
FIG. 3A is an unassembled plan view of an exemplary container according to a second embodiment.
Figure 3B:
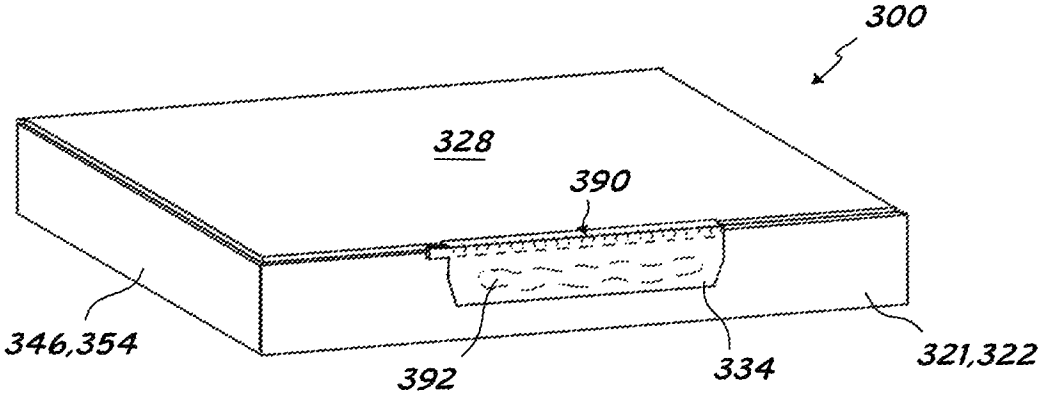
FIG. 3B is a perspective view of the second embodiment with the container assembled and sealed.
Figure 3C:
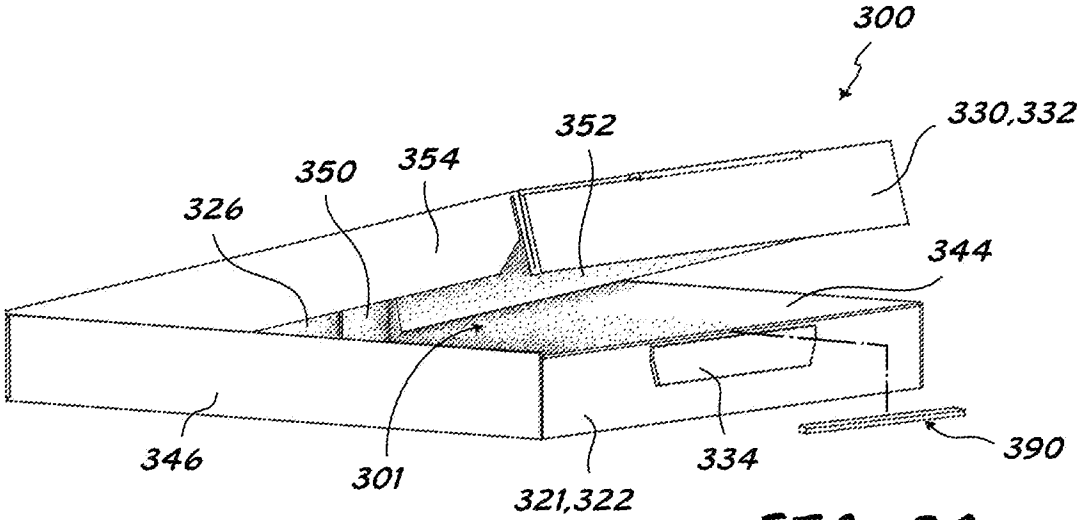
FIG. 3C is another perspective view of the second embodiment with the tear-tab removed, allowing the lid to be opened.

FIG. 3A is an unassembled plan view of an exemplary container according to a second embodiment. FIG. 3B is a perspective view of the second embodiment with the container assembled and sealed. FIG. 3C is another perspective view of the second embodiment with the tear-tab removed, allowing the lid to be opened.

FIG. 3A shows a blank 310 that includes panels 321, 322, 324, 326, 328, 330, 332, 334. These panels are connected along fold lines, which include both latitude fold line, indicated at 380, 381, 382, 383, 384, 386, 388, 391, 393, 396, 397, and longitudinal fold lines, indicated at 360 and 370, with individual segments of fold lines 360 at 362, 364, 366, and individual segments of fold line 370 at 372, 374, 376. Panels 321 and 322 are connected along fold lines 396, 397, panels 322 and 324 are connected along fold line 380, panels 324 and 326 are connected along fold line 382, panels 326 and 328 are connected along fold line 384, panels 328 and 330 are connected along fold line 386, panels 330 and 332 are connected along fold line 388, and panels 332 and 334 are connected along fold lines 391 and 393. Additionally, a tear strip 390 is formed by the fold lines 391, 393 and tear assist feature 395. A tear tab 394 is shown attached to tear strip 390 and is sized to be grasped and separated along fold/tear lines 391, 393 with tear assist feature 395. Panels 330, 332, and 334 form an end of the blank 310 and will be articulated to provide a secure, openable, and reclosable feature.

The blank 310 also includes end flaps connected to select panels. As shown in FIG. 3A, end flap 344 is connected along fold line 366 to panel 324 along a first edge, and end flap 346 is connected along fold line 376 to panel 324 along a second edge. End flap 348 is connected along fold line 364 to panel 326 along the first edge, and end flap 350 is connected along fold line 374 to panel 326 along the second edge. End flap 352 is connected along fold line 362 to panel 328 along the first edge, and end flap 354 is connected along fold line 372 to panel 328 along the second edge. Additionally, an end flap 340 is connected to end flap 344 along fold line 381, and an end flap 342 is connected along fold line 383 to end flap 346. Additionally, a gap, nick, or space is shown between end flap 340 and panel 322 and a gap, nick, or space is shown between end flap 342 and panel 322.

FIG. 3A shows the inside 312 of blank 310. Additionally, an adhesive 392 can be disposed onto blank 310 for securement of the blank into a container configuration. As shown in FIG. 3A, the adhesive 392 in this exemplary embodiment is glue that has been applied to panel 334.

FIG. 3B shows the blank 310 being disposed in a parallelepipedal configuration with the panels being folded from the orientation shown in FIG. 3A to form a closed container 300. As the blank 310 is folded, in the exemplary embodiment shown, panel 328 becomes a top of the container 300 and is spaced essentially parallel and disposed directly above panel 324. Panel 326 becomes a rear wall and panels 322 and the combination of panels 321, 322, 330, 332 form a front disposed substantially parallel and opposite panel 326. End flaps 340, 342, 344, 346, 348, 350, 352, 354 together form opposite side walls of container 300. Specifically, end flaps 344, 352 form one side with end flaps 348 and 340 being folded into an interior of the container 300 and, optionally, glue can be applied at any position along, for example, end flaps 340 or 348 to secure a lower half of the container 300 together. The other side of the container 300 is formed by end flaps 346 and 354, with end flaps 342 and 350 being folded into an interior of the container 300 and, optionally, adhesive or glue can be applied at any position there along, for example, an adhesive could be applied onto on end flaps 342 and 350 to secure a lower half of the container 300 together. While the container 300 is shown in a nesting configuration in FIGS. 3B and 3C, the container 300 could be formed in a clam-shelf configuration, similar to the container shown in FIGS. 6-8.

FIG. 3C shows the container 300 of FIG. 3B partially open to show an interior portion 301 of the container 300 and with panels 330 and 332 folded to be adjacent one another. Specifically, panel 330 is folded along fold line 386 to be disposed opposite panel 326 in an interior 301 of container 300. Panel 332 is folded along fold line 388 to be disposed adjacent and substantially parallel to panel 330. Panel 334 is folded or otherwise articulated along at least a portion of fold line 391, 393. In FIG. 3C, the thickness or width of tear strip 390 between panels 332 and 334 allow for articulation of panel 334 over and there along panel 332 on an exterior portion 302 of the carton. The adhesive 392, as applied to an interior side of panel 334, allows panel 334 to be secured to an exterior portion of panel 322 with the adhesive acting as a seal or other securement means. In at least one embodiment, the adhesive 392 is strong enough and/or fast setting enough to quickly and immediately adhere the interior of panel 334 to the exterior panel 322. In this manner, once the adhesive is applied, detachment of the panel 334 from panel 322 in any manner, such as by separating tear lines 391, 393 by tear strip 390, will result in either tearing of panel 334 or 322, or both, or will provide a visual indication that the carton 300, which had been previously sealed, had been subsequently opened. In at least one instance, separation of the tear strip 390 along tear lines 391, 393 will provide the visual indication that the adhesive was previously engaged and the container 300 had been subsequent opened along the tear strip 390. As long as the tear strip remains intact in this exemplary embodiment, the food or other item placed in the container 300 prior to sealing, such as by the adhesive 392 or otherwise, would be secured therewithin the container 300 as originally packaged.

In order to use the seal shown in FIGS. 3A, 3B, and 3C, at least a portion of panel 334 is removed by separating the tear strip 390 there along to expose the interior 301 of the container 300 by lifting panel 328 upwardly along fold line 384. In at least one exemplary embodiment, the adhesive 392 can be covered by a tab or other cover (not shown). The tab can be exposed, such as by peeling off, to reveal an adhesive portion. The panel 334 is then folded closed with the adhesive portion securing panel 334 to panel 322. When the container 300 is to be opened, the tab defines a tear-away portion which allows the mating sections to be hinged or otherwise opened.

Figure 4A:
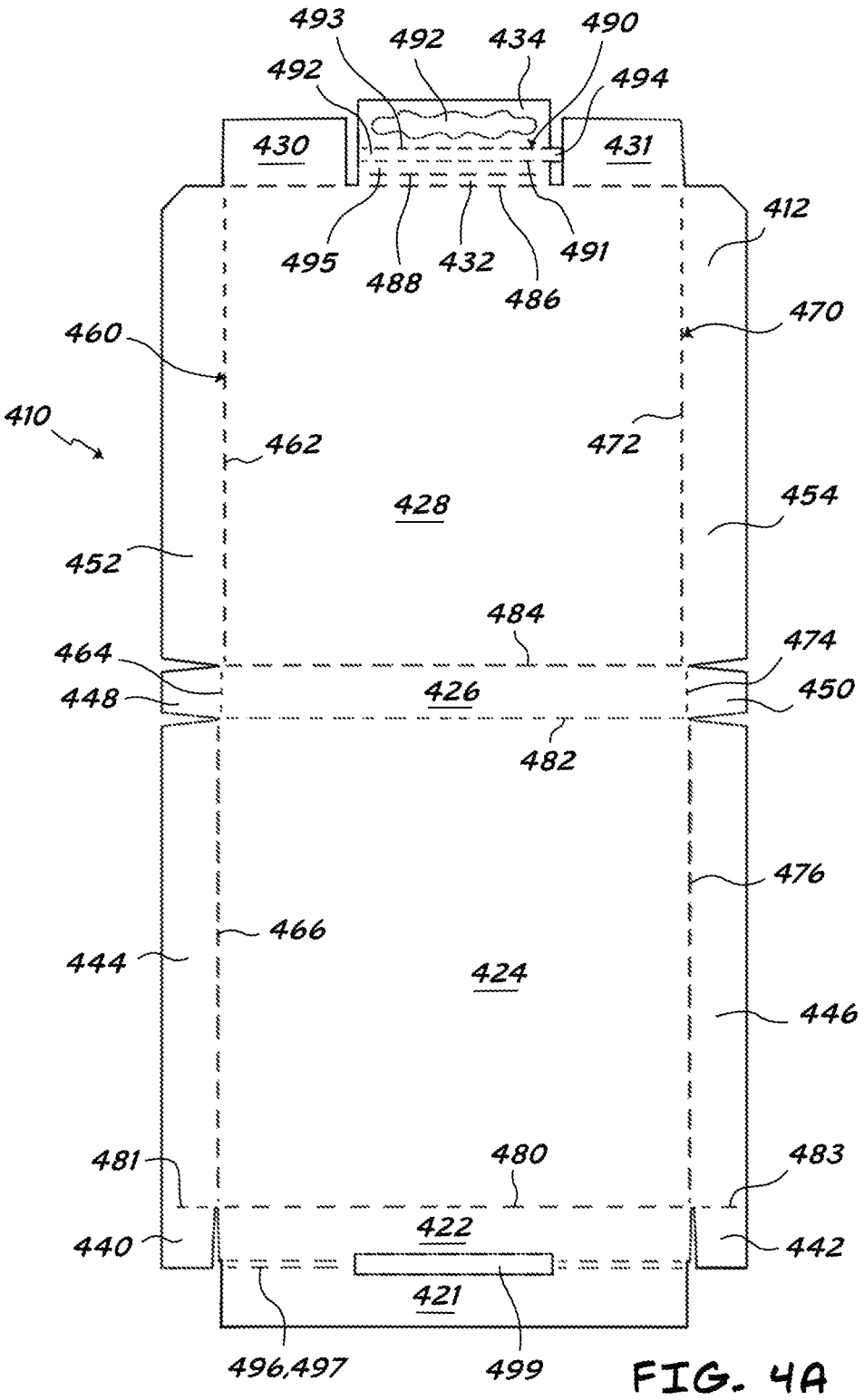
FIG. 4A is an unassembled plan view according to a third embodiment.
Figure 4B:
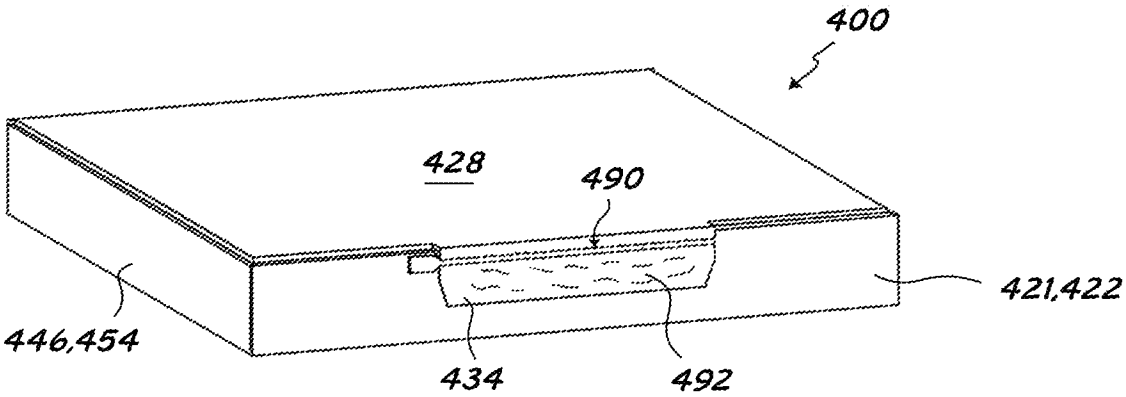
FIG. 4B is a perspective view of the third embodiment assembled and sealed.
Figure 4C:
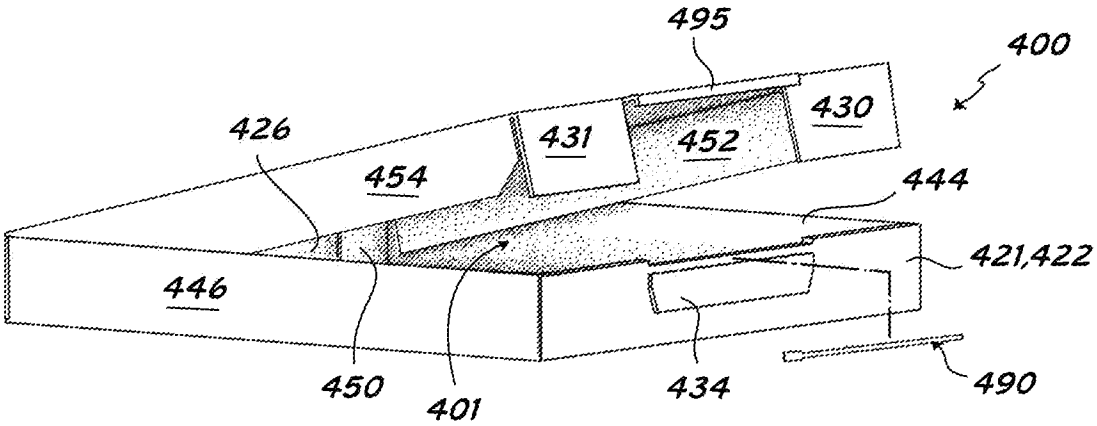
FIG. 4C is another perspective view of the third embodiment showing the tear-tab removed which allows the lid to be opened.

FIG. 4A is an unassembled plan view according to a third embodiment. FIG. 4B is a perspective view of the third embodiment assembled and sealed. FIG. 4C is another perspective view of the third embodiment showing the tear-tab removed which allows the lid to be opened.

FIG. 4A shows a blank 410 that includes panels 421, 422, 424, 426, 428, 430, 431, 432, 434 connected along fold lines, which include both latitude fold line, such as are indicated at 480, 481, 482, 483, 484, 486, 488, 491, 493, 496, 497, and longitudinal fold lines, such as are indicated at 460 and 470, with individual segments of fold lines 460 at 462, 464, 466 and individual segments of fold line 470 include 472, 474, 476. Panels 421 and 422 are connected along fold lines 496, 497, panels 422 and 424 are connected along fold line 480, panels 424 and 426 are connected along fold line 482, panels 426 and 428 are connected along fold line 484, panels 428 and 430, 431, 432 are connected along fold line 486, panels 430 and 495 are connected along fold line 488, and panels 432 and 434 are connected along fold lines 491, 493. Additionally, a tear strip 490 is formed by fold lines 491, 493. A tear tab 494 is shown attached to tear strip 490 and is sized to be grasped and separated along fold/tear lines 491, 493. Panels 430, 431, 432, and 434 form an end of the blank 410 and will be articulated to provide a secure, openable, and reclosable feature. Also shown in FIG. 4A, a relief notch or opening 499 is provided along the tear lines 496, 497 between panels 421, 422. The relief notch 499 can ease folding of the blank 410 into a container 400 configuration and can provide a slot or other void to allow receipt of another portion of blank 410, such as shown in FIG. 4C where the panels 421, 422 include a step formed by the relief notch 499 above a remainder portion of panel 434, which is shown remaining adhered to the container 400 when the tear strip 490 has been removed.

The blank 410 also includes end flaps connected to several of the panels. As shown in FIG. 4A, end flap 444 is connected along fold line 466 to panel 424 along a first edge, and end flap 446 is connected along fold line 476 to panel 424 along a second edge. End flap 448 is connected along fold line 464 to panel 426 along the first edge, and end flap 450 is connected along fold line 474 to panel 426 along the second edge. End flap 452 is connected along fold line 462 to panel 428 along the first edge, and end flap 454 is connected along fold line 472 to panel 428 along the second edge. Additionally, an end flap 440 is connected to end flap 444 along fold line 481, and an end flap 442 is connected along fold line 483 to end flap 446. Additionally, a gap, nick, or space is shown between end flap 440 and panel 422 and a gap, nick, or space is shown between end flap 442 and panel 422.

FIG. 4A shows the inside 412 of blank 410. Additionally, an adhesive 492 can be disposed onto blank 410 for securement of the blank into a container. As shown in FIG. 4A, the adhesive 492 in this exemplary embodiment is glue that has been applied to panel 434.

FIG. 4B shows the blank 410 being disposed in a parallelepipedal configuration with the panels being folded from the orientation shown in FIG. 4A to form a closed container 400. As the blank 410 is folded, in the exemplary embodiment shown, panel 428 becomes a top of the container 400 and is spaced essentially parallel and disposed directly above panel 424. Panel 426 becomes a rear wall and panels 422 and the combination of panels 421, 422, 430, 431, 432 form a front disposed opposite panel 426. End flaps 440, 442, 444, 446, 448, 450, 452, 454 together form opposite side walls of container 400. Specifically, end flaps 444, 452 form one side with end flaps 448 and 440 being folded into an interior of the container 400 and, optionally, glue can be applied at any position along, for example, end flaps 440 or 448 to secure a lower half of the container 400 together. The other side of the container 400 is formed by end flaps 446 and 454, with end flaps 442 and 450 being folded into an interior of the container 400 and, optionally, glue can be applied at any position there along, for example, an adhesive could be applied onto end flaps 442 and 450 to secure a lower half of the container 400 together. While the container 400 is shown in a nesting configuration in FIGS. 4B and 4C, the container 400 could be formed in a clam-shelf configuration, similar to the container shown in FIGS. 6-8.

FIG. 4C shows the container 400 of FIG. 4B partially open to show an interior portion 401 of the container 400 and with panels 430, 431, and 432 folded to be adjacent one another. Specifically, panel 430 is folded along fold line 486 to be disposed opposite panel 426 in an interior 401 of container 400. Panel 432 is folded along fold line 488 to be disposed adjacent and substantially parallel to panel 430. Panel 434 is folded or otherwise articulated along at least a portion of fold line 491, 493. In FIG. 4C, the thickness or width of tear strip 490 between panels 432 and 434 allow for articulation of panel 434 over and there along panel 432 on an exterior portion 402 of the carton. The adhesive 492, as applied to an interior side of panel 434, allows panel 434 to be secured to an exterior portion of panel 422 with the adhesive acting as a seal or other securement means. In at least one embodiment, the adhesive 492 is strong enough and/or fast setting enough to quickly and immediately adhere the interior of panel 434 to the exterior panel 422. In this manner, once the adhesive is applied, detachment of the panel 434 from panel 422 in any manner, such as by separating tear lines 491, 493 by tear strip 490, will result in either tearing of panel 434 or 422, or both, or will provide a visual indication that the carton 400, which had been previously sealed, had been subsequently reopened. In at least one instance, separation of the tear strip 490 along tear lines 491, 493 will provide the visual indication that the adhesive was previously engaged and the container 400 had been subsequent opened along the tear strip 490. As long as the tear strip 490 remains intact in this exemplary embodiment, the food or other item placed in the container 400 prior to sealing, such as by the adhesive 492 or otherwise, would be secured therewithin the container 400 as originally packaged.

In order to use the seal shown in FIGS. 4A, 4B, and 4C, at least a portion of panel 434 is removed, generally, the tear strip 490, which is separated there along to expose the interior 401 of the container 400 by lifting panel 428 upwardly along fold line 484. In at least one exemplary embodiment, the adhesive 492 can be covered by a tab or other cover (not shown). The tab can be exposed, such as by peeling off, to reveal an adhesive portion. The panel 434 is then folded closed with the adhesive portion securing panel 434 to panel 422. When the container 400 is to be opened, the tab 494 defines a tear-away portion which allows the mating sections to be hinged or otherwise opened.

Figure 5A:
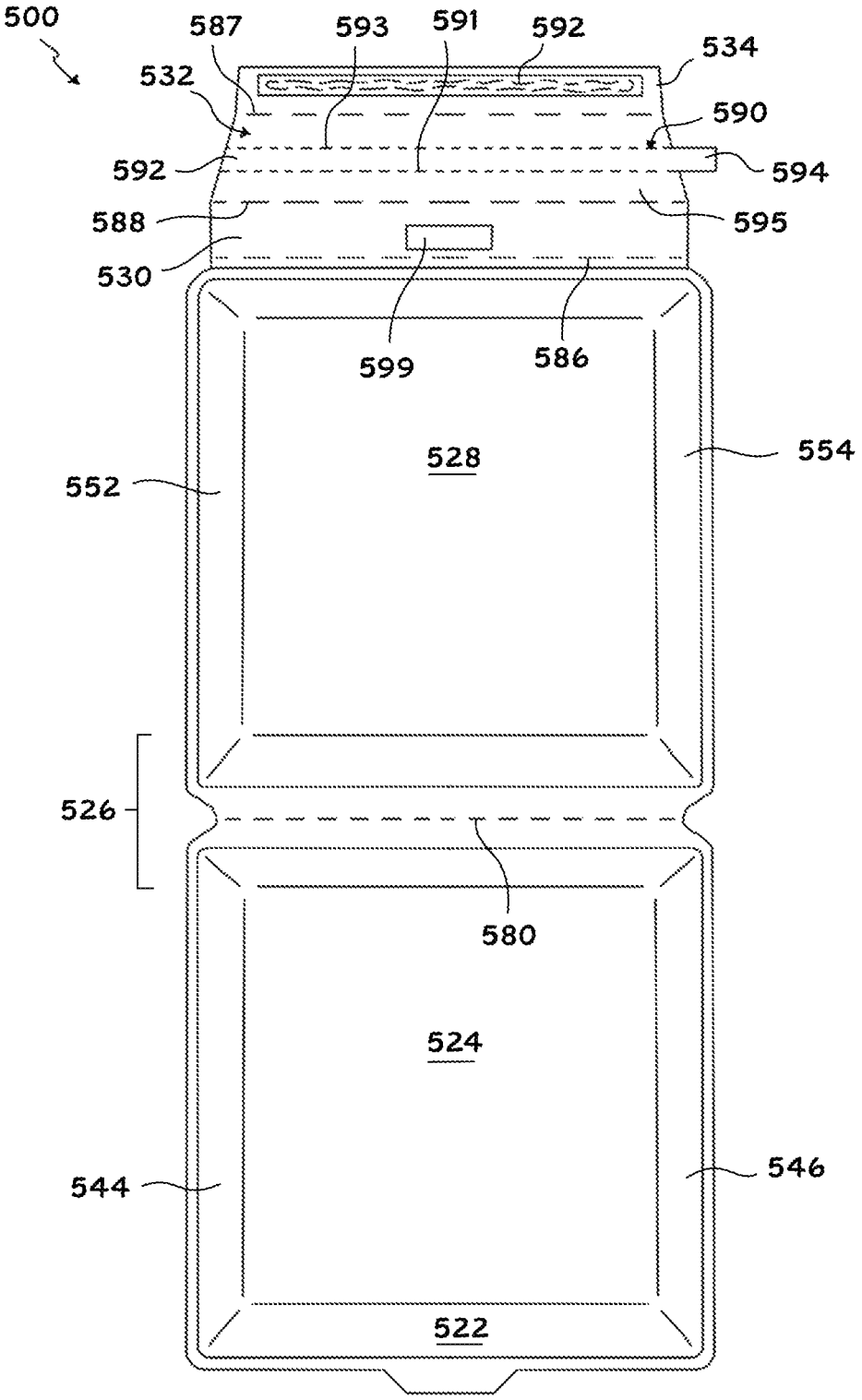
FIG. 5A is a plan view of an exemplary container according to a fourth embodiment.
Figure 5B:
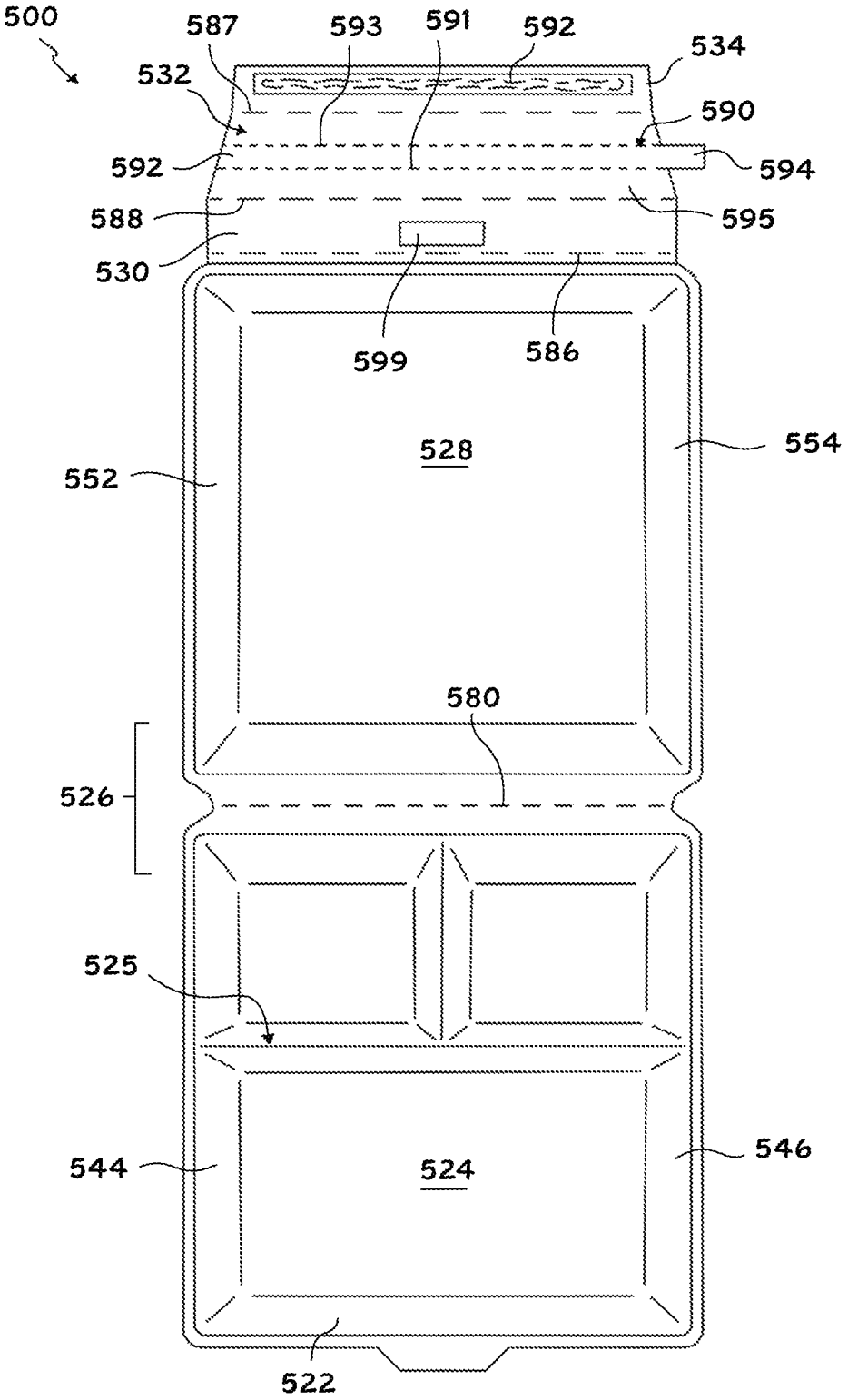
FIG. 5B is a plan view of an exemplary container according to the fourth embodiment that includes dividers.
Figure 6:
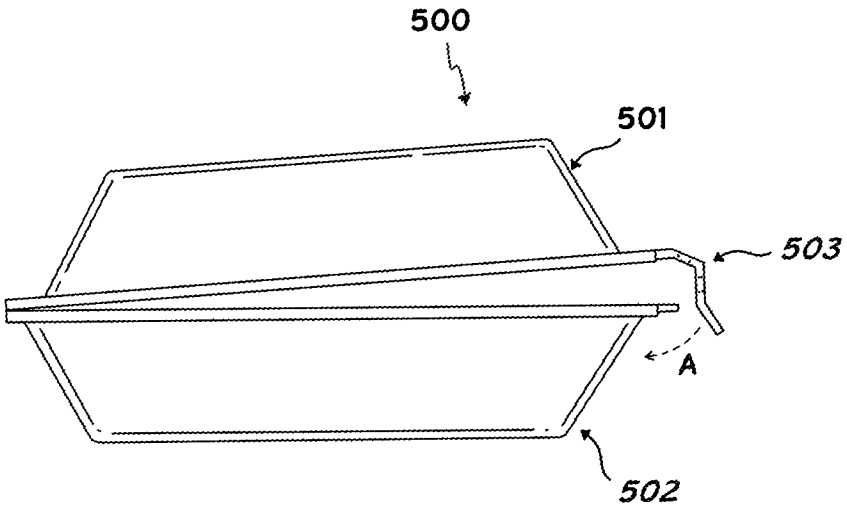
FIG. 6 is a side elevational view of the fourth embodiment with the container closed.
Figure 7:
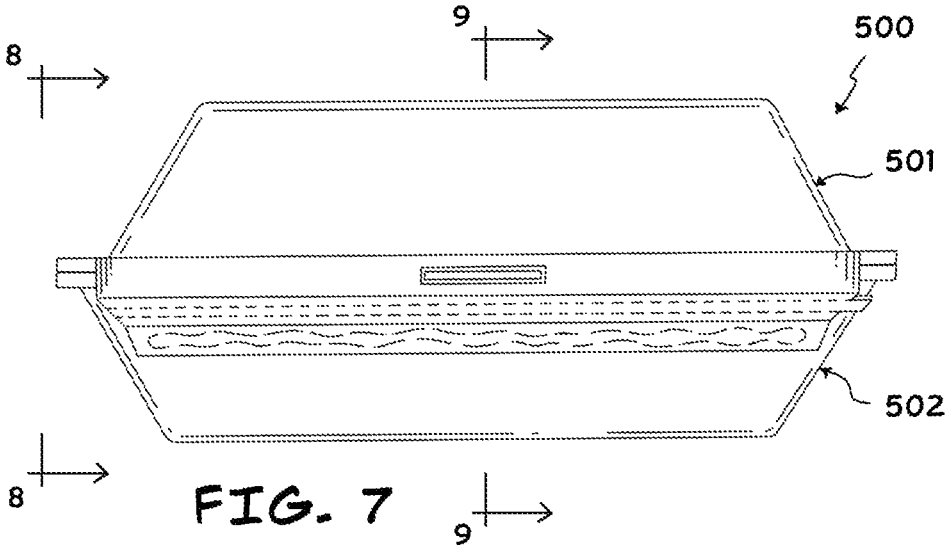
FIG. 7 is a front elevational view of the fourth embodiment with the container assembled and sealed.
Figure 8:
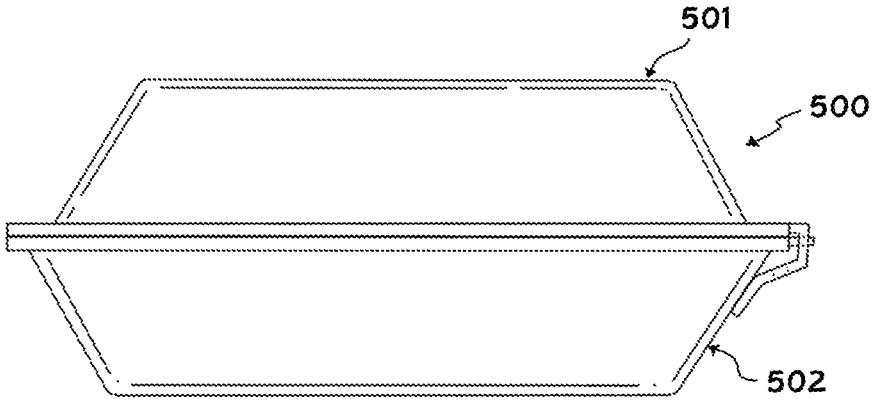
FIG. 8 is a side elevational view of the fourth embodiment with the container assembled and sealed.
Figure 9:
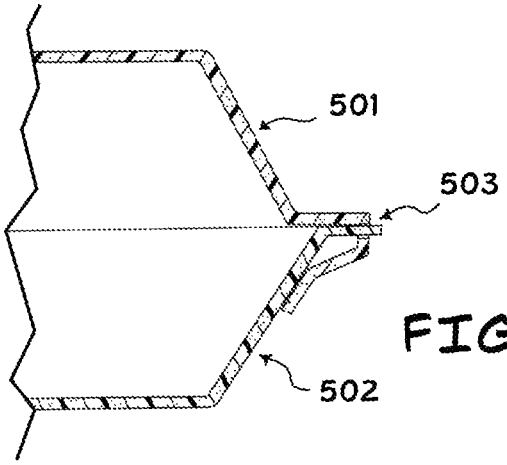
FIG. 9 is a cross sectional view of a closure portion of the container of the fourth embodiment.

FIG. 5A is a plan view of an exemplary container according to a fourth embodiment. FIG. 5B is a plan view of an exemplary container according to the fourth embodiment that includes dividers. FIG. 6 is a side elevational view of the fourth embodiment with the container being closed. FIG. 7 is a front elevational view of the fourth embodiment with the container assembled and sealed. FIG. 8 is a side elevational view of the fourth embodiment with the container assembled and sealed. FIG. 9 is a cross sectional view of a closure portion of the container of the fourth embodiment.

FIG. 5A shows a blank 510 that includes panels 522, 524, 526, 528, 530, 532, 534, which are connected along fold lines, indicated at 580, 586, 587, 588, 591, 593. A tear strip 590 is formed by fold lines 591, 593. A tear tab 594 is shown attached to tear strip 590 and is sized to be grasped and separated along fold/tear lines 591, 593. Panels 530, 532, and 534 form an end of the blank 510 and can be articulated to provide a secure, openable, and re-closable feature. Also shown in FIG. 5, a relief notch or opening 599 is provided between fold lines 586 and 588 in panel 530. The relief notch 599 can ease folding of the blank 510 into a container 500 configuration and can provide a slot or other void to allow receipt of another portion of blank 510. The blank is shown in a clamshell configuration with a first half of the container being able to be disposed over a second half of the container. In a clamshell configuration as shown, the first half and the second half have similar exterior dimensions to allow the container to be fully enclosed.

FIG. 5A shows the inside 512 of blank 510. Additionally, an adhesive 592 can be disposed on blank 510 for securement of the blank into a container configuration as will be described in detail later here within. As shown in FIG. 5A, the adhesive 592 in this exemplary body is glue that has been applied to panel 534. FIG. 5B is a plan view of an exemplary container according to the fourth embodiment that includes dividers 525, but otherwise the blank of FIG. 5B includes similar features as FIG. 5A.

FIG. 6 shows the blank 510 disposed in a closed position with a first half of the container 501 being disposed over a second half of the container 502. A closing portion 503 is formed at an end of first half 501. The first half 501 and the second half 502 are hinged about fold line 580 when moving to and from the closed position.

FIG. 7 shows a front elevation view of the container 500 formed from the blank 510 with the container 500 assembled and sealed. FIG. 8 shows a side elevation view of the container 500 assembled and sealed with the seal 503 securing first half 501 to second half 502. FIG. 9 shows a cross-sectional view of the closure portion 503 of the container 500.

Figure 10:
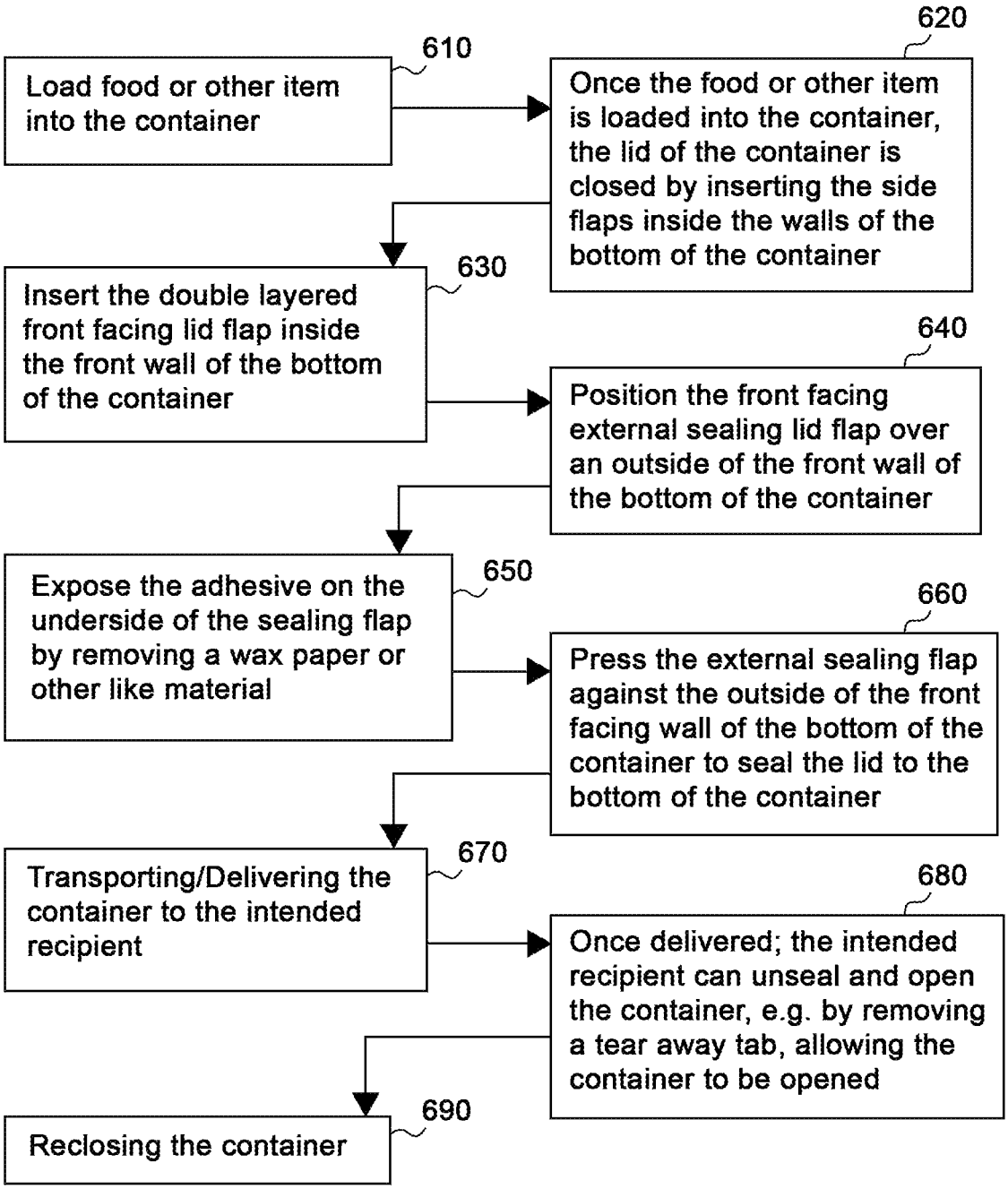
FIG. 10 shows an exemplary method of use of an exemplary container according to the first or second embodiment.

FIG. 10 shows an exemplary method of use of an exemplary container according to the first or second embodiment. First, at step 610, food or another item is loaded into the container. At step 620, the container is closed by inserting the side lid flaps inside the walls of the bottom of the container. Next, at step 630, the double layer front facing lid flap is inserted inside the front wall of the bottom of the container. At step 640, the front facing external sealing lid flap is positioned over and outside the front wall of the container. At step 650, the adhesive on the underside of the sealing flap is exposed or activated. At step 660, the external sealing flap is pressed against the outside of the front facing wall of the bottom of the container to seal the lid to the bottom of the container, fully enclosing the container. At step 670, once the container is sealed, it cannot be opened without a visual indication that the container has been opened. The container is delivered to its intended recipient. At step 680, the recipient can open the container by removing a portion of the external sealing flap to release the lid. At step 690, the internal flap allows the container to be reclosed and reopened.

Figure 11:
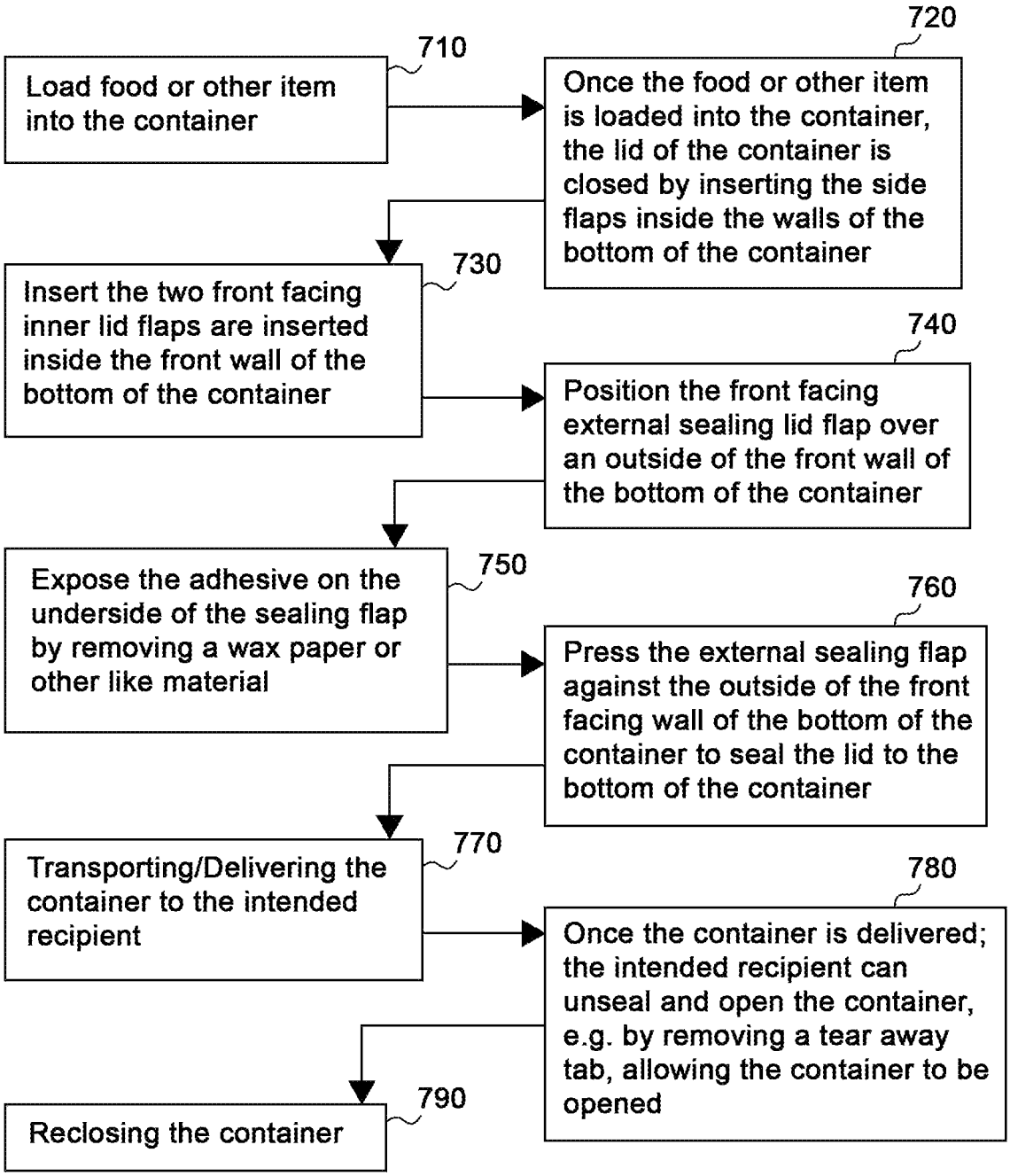
FIG. 11 shows an exemplary method of use of an exemplary container according to the third embodiment.

FIG. 11 shows an exemplary method of use of an exemplary container according to the third embodiment. First, at step 710, food or another item is placed in the container. At step 720, the container is closed by inserting the side lid flaps inside the walls of the bottom of the container. Next, at step 730, the two front facing inner lid flaps are inserted inside the front wall of the bottom of the container. At step 740, the front facing external sealing lid flap is positioned over and outside the front wall of the container. At step 750, the adhesive on the underside of the sealing flap is exposed or activated. At step 760, the external sealing flap is pressed against the outside of the front facing wall of the bottom of the container to seal the lid to the bottom of the container, fully enclosing the container. At step 770, once the container is sealed, it cannot be opened without a visual indication that the container has been opened. The container is delivered to its intended recipient. At step 780, the recipient can open the container by removing a portion of the external sealing flap to release the lid. At step 790, the internal flap allows the container to be re-closed and reopened.

Figure 12:
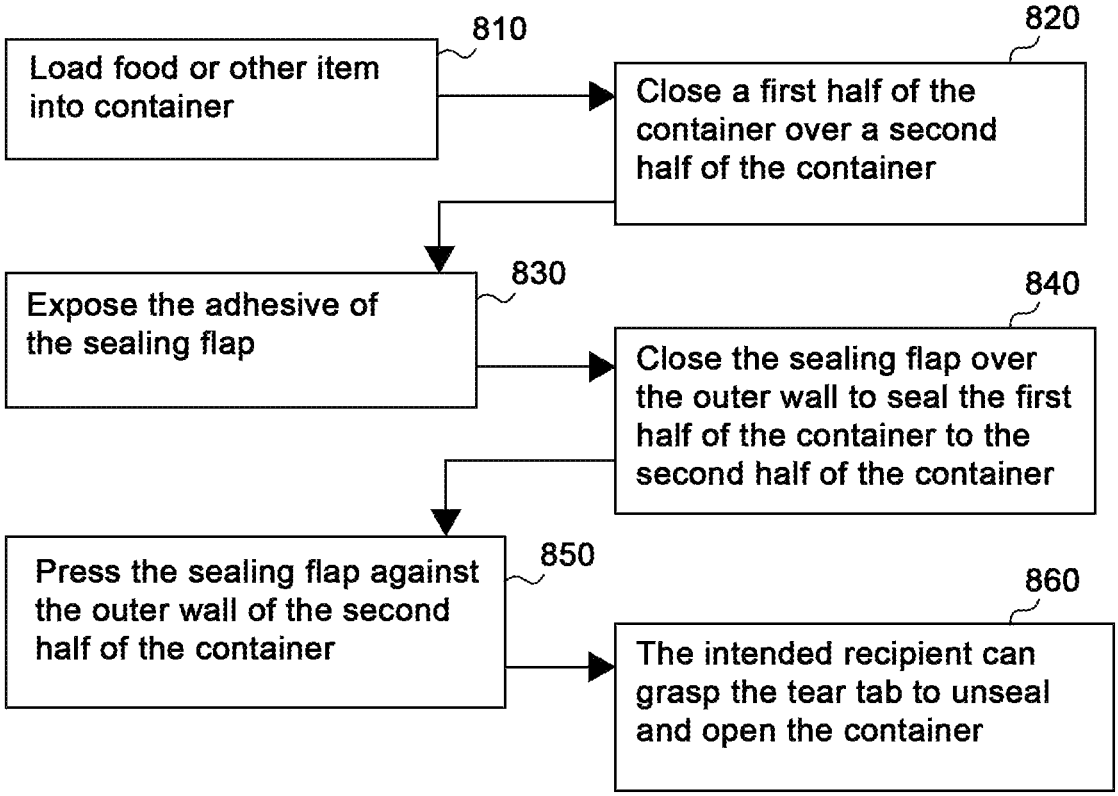
FIG. 12 shows exemplary method of the use of an exemplary container according to the fourth embodiment.

FIG. 12 shows exemplary method of the use of an exemplary container according to the fourth embodiment. At step 810, food or another item is loaded into the second half of the container. At step 820, the first half of the container is closed over the second half of the container. At step 830, and adhesive is exposed on the underside of a sealing flap. At step 840, the sealing flap is closed over the outer wall to seal the first half of the container to the second half of the container. At step 850, the sealing flap is pressed against the outer wall of the second half of the container. At step 860, once the containers delivered, the recipient can unseal and open the container by removing a portion of the sealing flap.

Figure 13A:
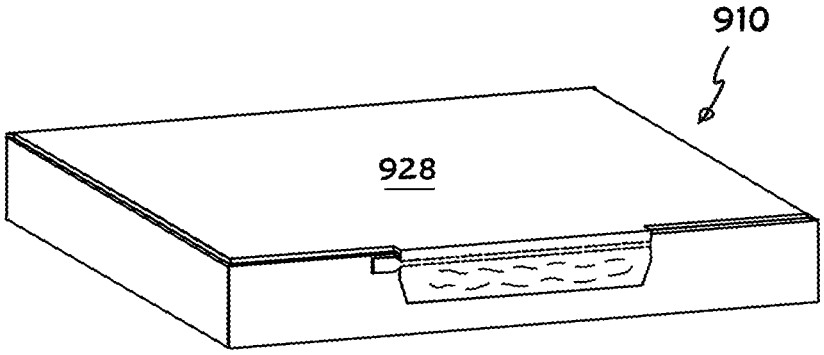
FIGS. 13A and 13B show a fifth embodiment of a container with trackable features.
Figure 13B:
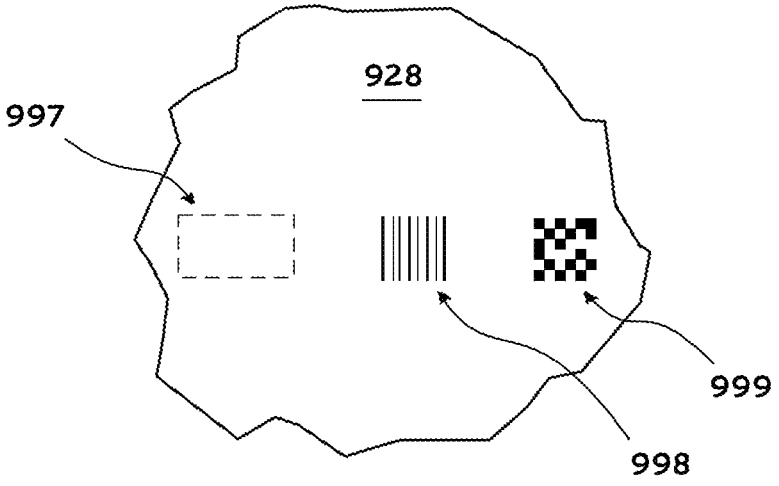

FIGS. 13A and 13B show a fifth embodiment of a container 910. The container 910 includes a panel 928 and is shown with additional, optional features, including, e.g., trackable features, for example, tracking device 997, barcode 998, and QR code 999. Although these features are shown on panel 928, these optional features can be included on any panel or flap of the container 910.

The exemplary containers detailed herein can prevent tampering or other exposure of the contents of a sealed container before being delivered and opened by the intended recipient or authorized user. Additionally, the exemplary containers detailed herein prevent accidental exposure and possible contamination while the sealed container is in transit by preventing the package from opening due to unexpected events, e.g., the container being dropped or the delivery vehicle making a sudden stop and the sealed container shifting, tipping, or falling. In at least one embodiment, the container includes an additional front facing flap which is used to seal the lid closed and is also able to be separated from the lid by way of a tear away pull-tab. When the tear-tab is removed, the external front facing flap remains adhered to the bottom front facing wall due to the adhesive, but is severed from the lid of the container allowing the container to open freely. The containers detailed herein includes internal and external front facing lid flaps that allow the container to be re-closed after the external sealing flap has been severed. In at least one embodiment, the internal front facing flap can be formed by an upward folding portion of the container that includes enough material to extend back to the top edge of the container. In at least one embodiment, the external front facing removable flap is formed by including enough material to extend and fold down the front face of the bottom of the container. The removable flap can be formed with a shorter length "flap" than the other flaps. In at least one embodiment, a portion of the front facing lid flap includes a serrated strip on a top edge, which, when pulled and removed, severs the flap from the lid to release the lid from the lower portion of the container. In at least one embodiment, the lid flap that adheres to the bottom of the container is released by pulling the tear-tab which severs the sealing flap from the lid/upper portion of the container, leaving the rest of the flap adhered to the bottom of the container. The additional front-facing internal lid flaps of the container allows allow the container to be reclosed even after being unsealed and having the sealing flap removed from the lid by the intended recipient or authorized user. The container can be stamped out of a single piece of cardboard, paperboard, or any other material used to manufacture containers or boxes.

In at least one embodiment, the container can incorporate barcodes, RFID tags, microchips, or any other technology for the purpose of tracking the container and item(s) being sealed. Tracking can record either of, or any of the following data points; time, location, contents of items, names and contact information of the sender/shipper/merchant, the delivering/transporting party and any other intermediaries, and the intended recipient/customer.

The container can include additional features, including, for example, a relief notch in the top edge of the front wall of the bottom of the container. The notch can provide the external sealing flap room to let the lid of the container to lay level when closed when the sealing flap is folded into place. Alternatively, in at least one embodiment, the front wall of the bottom of the container can be formed shorter than the other side walls to provide relief to let the lid lay flat while in the closed position and the external sealing flap wraps down the front of the container. In at least one embodiment, the removable external lid flap could span the length of the front face of the container. In at least one embodiment, external adhering lid flaps and internal lid flaps can be provided on all three unhinged sides of the container. Further, a fourth set of internal and external flaps could be provided in place of the hinged side of the container. In one exemplary embodiment, two separate internal front facing flaps can be provided by cutting the external flap out of the same section of the container material, which would reduce the amount of material needed to manufacture the container.

Optionally, though not shown in the exemplary figures, the external sealing lid flap could be constructed separately from the rest of the container. Additionally, an external lid flap could be applied to a conventional container bottom as a lid, e.g., as a lid over a conventional pizza container box. A lid flap in this configuration would include a strip of material capable of being folded or otherwise readily disposable, e.g. by bending, over/onto one side. The strip of material could be a perforated tape like material, that can extend along the side and could optionally span the length of the strip. The underside of the strip could include two adhesive strips spanning the edges of length of the strip keeping the middle bent and the perforated tab clear of the adhesive.

The pull tabs on the containers can extend any desired length, including along any length along the container, including the entire length of a side of the container. The tab can extend along more than one side of the container. The tab or tabs are typically equipped with the adhesive that can be exposed by removing the backing, which, in at least one embodiment, can be formed of wax paper or another non-stick material. Alternatively, the adhesive or sealing means can be disposed on a side wall of the container to receive the tab or flap to dispose the container in a sealed and closed position Even further, the blank can be modified to fold the top of the container entirely within the bottom of the container and the adhesive can be provided on an interior wall portion to receive a portion of the tab or flap. Further, the tab(s) may be affixed to the top or the bottom half of the container, or the tab(s) may be affixed partially to both the top half and the bottom half of the container.

The present disclosure can be understood more readily by reference to the instant detailed description, examples, and claims. It is to be understood that this disclosure is not limited to the specific systems, devices, and/or methods disclosed unless otherwise specified, as such can, of course, vary. It is also to be understood that the terminology used herein is for the purpose of describing particular aspects only and is not intended to be limiting.

The instant description is provided as an enabling teaching of the disclosure in its best, currently known aspect. Those skilled in the relevant art will recognize that many changes can be made to the aspects described, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the instant description is provided as illustrative of the principles of the present disclosure and not in limitation thereof.

As used herein, the singular forms "a," "an" and "the" include plural referents unless the context clearly dictates otherwise. Thus, for example, reference to a "body" includes aspects having two or more bodies unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Although several aspects of the disclosure have been disclosed in the foregoing specification, it is understood by those skilled in the art that many modifications and other aspects of the disclosure will come to mind to which the disclosure pertains, having the benefit of the teaching presented in the foregoing description and associated drawings. It is thus understood that the disclosure is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described disclosure.

What is claimed is:

1. A self-sealing container comprising:

two container sections with sidewalls, with the two container sections being connected along a fold line; wherein the container is formed when the two container sections are folded along the fold line to a closed position to form a closed container;

a securing feature that seals the closed container in a sealed position;

wherein the securing feature includes at least two flaps connected along a common fold line;

wherein the securing feature seals to an exterior of a sidewall of the sidewalls;

wherein the securing feature provides a visual indication that the closed container has been opened from the sealed position;

wherein the container further comprises a closure feature that allows the container to be retained in the closed position after the securing feature has been released or after the closed container has been opened from the sealed position.

2. The container of claim 1 wherein the two container sections are capable of mating to close the container.

3. The container of claim 1 wherein the closure feature comprises at least two flaps that include a first flap and a second flap, with the first flap being connected to one of the two container sections and with the second flap being connected to the first flap along a closure feature fold line.

4. The container of claim 3 wherein the first flap includes the closure feature that allows the container to be retained in the closed position after the container has been opened from the sealed position.

5. The container of claim 3 wherein the second flap includes sealing means that secures the second flap to the container to seal the container in the sealed position.

6. The container of claim 5 wherein the sealing means is an adhesive that is covered by a cover that is removable to expose the adhesive.

7. The container of claim 5 wherein the sealing means includes a tear tab that separates at least a portion of the second flap from the container and the tear tab separation provides the visual indication of opening.

8. The container of claim 1 wherein the visual indication is (1) alteration of the container including by tearing, ripping, or otherwise varying an outer surface of the container or outer flap or (2) separation of an outer sealing flap from an original position of the container.

9. The container of claim 1 wherein the container cannot be resealed with the sealing means after the closed container is opened.

10. The container of claim 1 wherein at least one identifier is provided, with the at least one identifier is chosen from: a barcode, a QR code, or RFID tag; and, wherein the at least one identifier indicates at least one of: order information, timestamp, supplier information, recipient information, promotional message(s), removal instructions, and any combination thereof.

* * * * *